US006332821B1

(12) United States Patent
Park et al.

(10) Patent No.: US 6,332,821 B1
(45) Date of Patent: Dec. 25, 2001

(54) METHOD FOR FABRICATING PLASMA DISPLAY DEVICE

(75) Inventors: Deuk-il Park; Moo-sung Kim; Choong-yop Rhew, all of Chonan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/461,327

(22) Filed: Dec. 15, 1999

(30) Foreign Application Priority Data

Dec. 15, 1998 (KR) ..... 98-55031

(51) Int. Cl.[7] ..... H01J 9/26
(52) U.S. Cl. ..... 445/25; 445/6; 445/40
(58) Field of Search ..... 445/24, 25, 6, 445/40

(56) References Cited

U.S. PATENT DOCUMENTS 5,176,558 * 1/1993 Newell ..... 445/6
5,207,607 * 5/1993 Nagano et al. ..... 445/25
5,564,958 * 10/1996 Itoh et al. ..... 445/42

FOREIGN PATENT DOCUMENTS

09251839-A * 9/1997 (JP) .

OTHER PUBLICATIONS

Machine translation of JP 09–251839 (document not prior art).*

* cited by examiner

*Primary Examiner*—Kenneth J. Ramsey
(74) *Attorney, Agent, or Firm*—Leydig, Voit, & Mayer, Ltd.

(57) ABSTRACT

A method and an apparatus for fabricating a plasma display device are disclosed. The method for fabricating a plasma display device includes installing in a heating chamber a plasma display device assembly in which frit glass coats the peripheries of substrates; heating the heating chamber while evacuating the plasma display device assembly and the heating chamber via respective exhaust lines; stopping the evacuation and heating of the heating chamber so the frit glass bonds the substrates, and cooling the heating chamber; filling the heating chamber with a discharge gas to atmospheric pressure when the temperature of the heating chamber reaches a predetermined temperature; and filling the plasma display device assembly with the discharge gas when the temperature of the plasma display device assembly reaches room temperature, and sealing the plasma display device assembly.

14 Claims, 2 Drawing Sheets

METHOD FOR FABRICATING PLASMA DISPLAY DEVICE

BACKGROUND OF THE INVENTION

1. Field of the Invention

The present invention relates to a method and an apparatus for fabricating a plasma display device, and more particularly, to a method of evacuating a plasma display device and filling it with a discharge gas and an apparatus for evacuating a plasma display device and filling it with a discharge gas.

2. Description of the Related Art

A plasma display device is a device for displaying images using gas discharge, and is spot-lighted as a display device which can replace a cathode ray tube (CRT) because the former has various excellent display characteristics such as resolution, luminance, contrast, latent image, and a view angle. In such plasma display device, discharge occurs in a discharge gas between electrodes by a DC or AC voltage applied across the electrodes, and a phosphor layer is excited by ultraviolet emission accompanying with the discharge to emit light rays.

FIG. 1 is an exploded perspective view schematically illustrating the structure of a conventional AC type plasma display device.

Referring to FIG. 1, transparent first electrodes 13*a* of display electrodes and second electrodes 13*b* of address electrodes are located between a front glass substrate 11 and a rear glass substrate 12. The first and second electrodes 13*a* and 13*b* are respectively located on the inner surfaces of the front and rear glass substrates 11 and 12 in stripe shapes, and are orthogonal with respect to each other when the substrates 11 and 12 are assembled. An dielectric layer 14 and a protective layer 15 are laminated on the inner surfaces of the front glass substrate 11 in sequence. On the other hand, at the rear glass substrate 12, partition walls 17 are formed on the upper surface of a dielectric layer 14', and cells 19 are formed by the partition walls 17. In addition, a phosphor layer 18 coats predetermined inside portions of the partition walls 17 forming the respective cells 19. An inert gas such as argon fills the cells 19.

The operation of the plasma display device configured as above is described as follows. First, a high voltage a so called trigger voltage is applied across the electrodes 13*a* and 13*b* to cause a discharge. When ions are accumulated in the respective dielectric layers 14 and 14', the discharge occurs. When the trigger voltage exceeds a threshold voltage, the discharge gas, such as argon, in the cell 19 goes into a plasma state by the discharge, and a stable discharge can be maintained between the electrodes 13*a* and 13*b*. In the stable discharge state, the rays in the ultraviolet range among rays emitted by the discharge collide with the phosphor layer 18 to emit light rays, and accordingly all pixels formed by the respective cells 19 display an image.

In assembling the plasma display device as above, after the electrodes, dielectric layers, partition walls, etc., are formed and the phosphor layer is applied, the substrates are bonded to each other. Air filled in the cells 19 of the display device right after bonding, and an air exhausting step is performed to remove the air and to fill the cells 19 with a discharge gas of argon. A vent hole is sealed after air exhaustion and filling of discharge gas.

In the conventional art, the air exhausting step is performed by connecting an exhaust pipe to a vent hole formed at a side of the substrate 12, and the plasma display device is heated simultaneously. That is, the inside of the panel is evacuated by a conventional vacuum pump via the exhaust pipe while the display device is heated. However, since the region of each cell 19 is a micro space whose width and height are in the range from several tens to several hundred micrometers, removing almost all the air contained in the cells 19 only by the vacuum pump is very difficult. Further, since the phosphor layer 18, partition walls 17, the protective layer 15 with a magnesium oxide material, etc. which are exposed to the cells 19 have surfaces with very complicated structures, and in particular the protective layer 15 has a characteristic of absorbing moisture, it is not easy to remove all materials absorbed in or combined to such surfaces in the air exhausting step. If the inside of the plasma display device is not evacuated sufficiently, there remains moisture, air, etc., within the panel, and these remaining materials bring a side effect of raising the voltage required for discharge, even though discharge begins within cells subsequently filled with a discharge gas. In addition, discharge in itself is impeded, and even though discharge occurs, sufficient ultraviolet rays cannot be emitted. Accordingly, the number of ultraviolet rays colliding with the phosphor layer decreases to lower the luminance.

SUMMARY OF THE INVENTION

To solve the above problems, it is an objective of the present invention to provide an improved method for fabricating a plasma display device.

It is another objective of the present invention to provide a method of exhausting air and filling a discharge gas in a plasma display device.

It is still another objective of the present invention to provide an apparatus for exhausting air and filling a discharge gas in a plasma display device.

Accordingly, to achieve the first objective, there is provided a method for fabricating a plasma display device comprising the steps of: installing in a heating chamber a plasma display device assembly in which frit glass is coated on the peripheries of substrates; heating the heating chamber while evacuating the plasma display device assembly and the heating chamber via respective exhaust lines; bonding upper and lower substrates of the plasma display device as the frit glass of the plasma display device is melted and spread over portions of the substrates to be bonded; stopping the evacuation and heating of the heating chamber and cooling the heating chamber to a predetermined temperature; filling the heating chamber with a predetermined gas to a normal pressure when the temperature of the heating chamber reaches a predetermined temperature; and filling the discharge gas into the plasma display device when the temperature of the plasma display device reaches room temperature, and closing the plasma display device.

According to one aspect of the present invention, before the step of closing the plasma display device, the method further comprises the steps of: connecting a discharge circuit to the plasma display device, and evacuating the discharge gas after causing the discharge gas within the plasma display device to discharge for a predetermined time; repeating the filling and evacuation of every another charge of the discharge gas in the plasma display device; and filling another charge of the discharge gas into the plasma display device finally, and closing the plasma display device.

According to another aspect of the present invention, the heating chamber is heated to a temperature in the range of 400° C. to 450° C. when heated.

According to still another aspect of the present invention, the step of filling the heating chamber with the predetermined gas to a normal pressure is carried out when the temperature of the heating chamber is 350° C.

According to still another aspect of the present invention, the frit glass is coated thicker than the height of partition walls of the device, and the partition walls contact the facing substrate closely when in the heating step the frit glass is melted and therefore the thickness of the frit glass decreases.

To achieve the second objective, there is provided a method for fabricating a plasma display device comprising the steps of: installing in a heating chamber a plasma display device assembly in which frit glass is coated on the peripheries of substrates; heating the heating chamber while evacuating the plasma display device assembly and the heating chamber; repeating more than twice that every another charge of a discharge gas is filled into, to a predetermined pressure and evacuated from the plasma display device assembly when the heating chamber is cooled down to a first predetermined temperature; and filling another charge of the discharge gas into the plasma display device to a predetermined pressure when the temperature of the heating chamber is further cooled down to a second predetermined temperature, and closing the plasma display device.

According to one aspect of the present invention, before the step of closing the plasma display device, the method further comprises the steps of: connecting a discharge circuit to the plasma display device, and evacuating the discharge gas after causing the discharge gas within the plasma display device to discharge for a predetermined time; repeating the filling and evacuation of the discharge gas in the plasma display device more than twice; and filling the discharge gas into the plasma display device finally, and closing the plasma display device.

According to another aspect of the present invention, the heating chamber is heated higher than 400° C.

According to still another aspect of the present invention, the discharge gas is filled into the plasma display device assembly at a pressure in the range of about 10 to 760 Torr in a state in which the heating chamber is cooled down to the first predetermined temperature.

According to still another aspect of the present invention, the pressure of the discharge gas filled into the plasma display device assembly for gas discharge is a pressure in the range of about 100 to 700 Torr.

According to still another aspect of the present invention, the pressure of the discharge gas filled into the plasma display device assembly after the gas discharge of the assembly is a pressure in the range of about 10 to 760 Torr.

According to still another aspect of the present invention, the discharge gas to be filled into the heating chamber is Ar or Ne.

According to still another aspect of the present invention, the discharge gas to be filled into the plasma display device assembly is Ne, or a mixture gas of Ne and Xe.

To achieve the third objective, there is provided an apparatus for fabricating a plasma display device comprising: a heating chamber in which a plasma display device assembly can be accommodated and a head for evacuating air or gas and filling a discharge gas is installed; a heater for raising the temperature of the heating chamber; an exhaust pipe for connecting a vent hole formed at the plasma display device assembly and the head installed in the heating chamber for evacuating air or gas and filling a discharge gas; piping installed for evacuating air or gas from and filling a discharge gas into the heating chamber and the plasma display device assembly; a vacuum pump and discharge gas filling equipments which are connected to the piping; and a plurality of valves for selectively opening and closing the piping.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
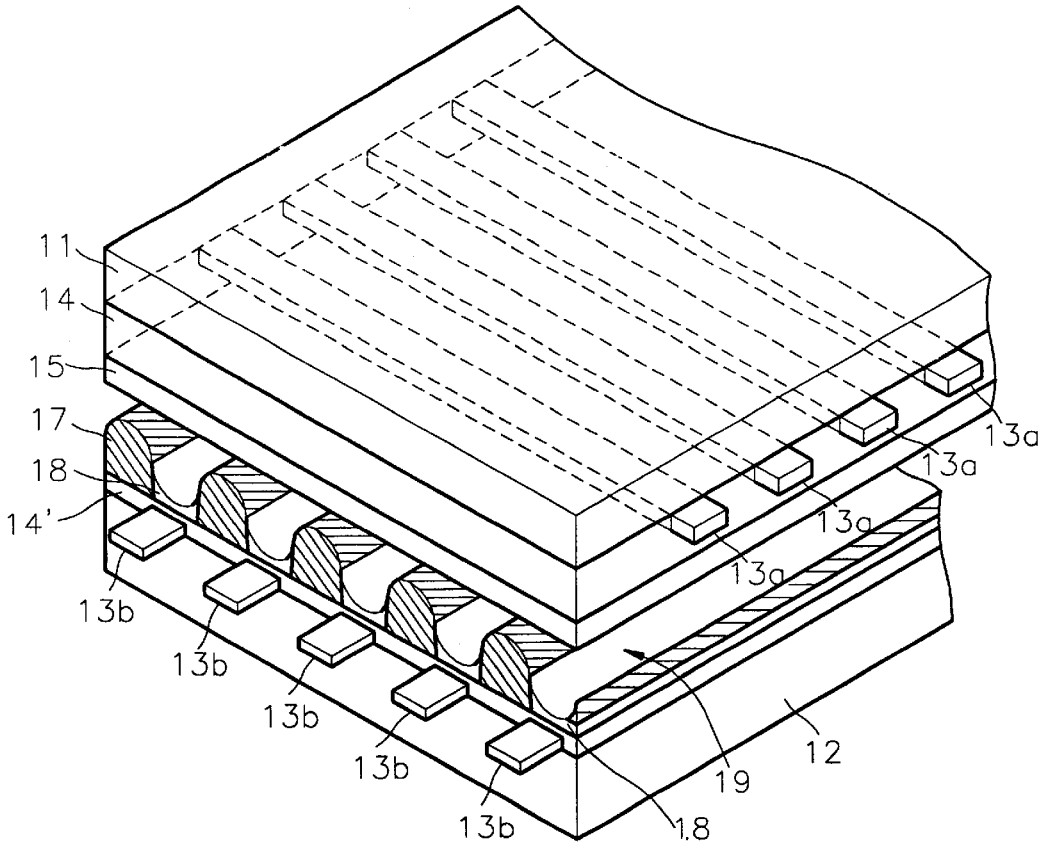
FIG. 1 is an exploded perspective view schematically illustrating a conventional plasma display device.
Figure 2:
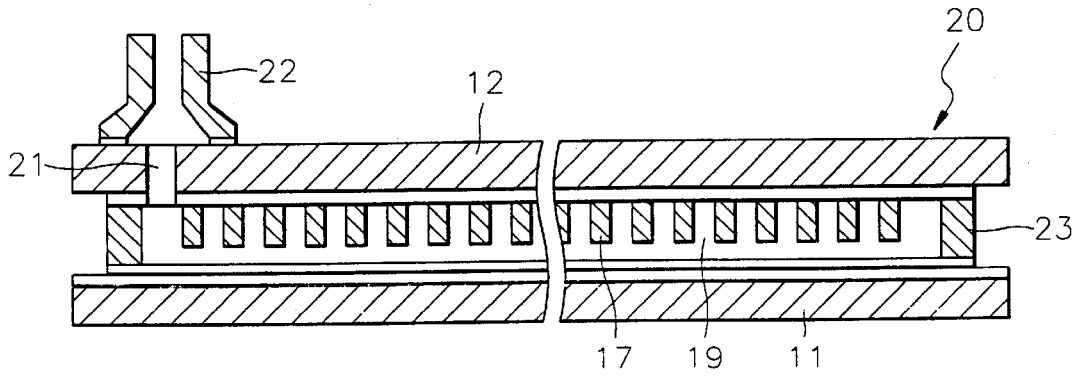
FIG. 2 is a schematic section view illustrating a plasma display device in which an exhaust pipe is installed.

FIG. 2 shows a cross section of a PDP (plasma display panel) assembly 20 assembled with a front glass substrate 11 and a rear glass substrate 12 which are provided with partition walls, etc., and the assembly 20 is in a state before bonding.

Referring to FIG. 2, frit glass 23 of an appropriate thickness coats the facing peripheries of the substrates 11 and 12 so as to bond the substrates 11 and 12 to each other. Such frit glass 23 is melted in a subsequent heating step to bond the substrates 11 and 12 to each other. At this time, the thickness of the frit glass 23 is decreased. The initial thickness of the frit glass 23 is set to be larger than the height of the partition walls, and thus the partition walls 17 do not completely contact the inner surface of the substrate 11 and air can be easily pumped out. In a heating step, the frit glass is melted, and the substrates 11 and 12 approach each other, and are bonded to each other while the partition walls 17 closely contact the substrate 11 facing the partition walls 17. Before the heating step, the facing substrates 11 and 12 are maintained in an assembled state by clips (not shown).

A vent hole 21 is formed on the rear substrate 12, and an exhaust pipe 22 is connected to the vent hole 21. Through the exhaust pipe 22, air is sucked from the inside of a display device. A discharge gas is supplied through the same pipe. After the plasma display device as assembled in FIG. 2 is placed in an airtight apparatus, the exhaustion of air and the filling with discharge gas can be carried out.

Figure 3:
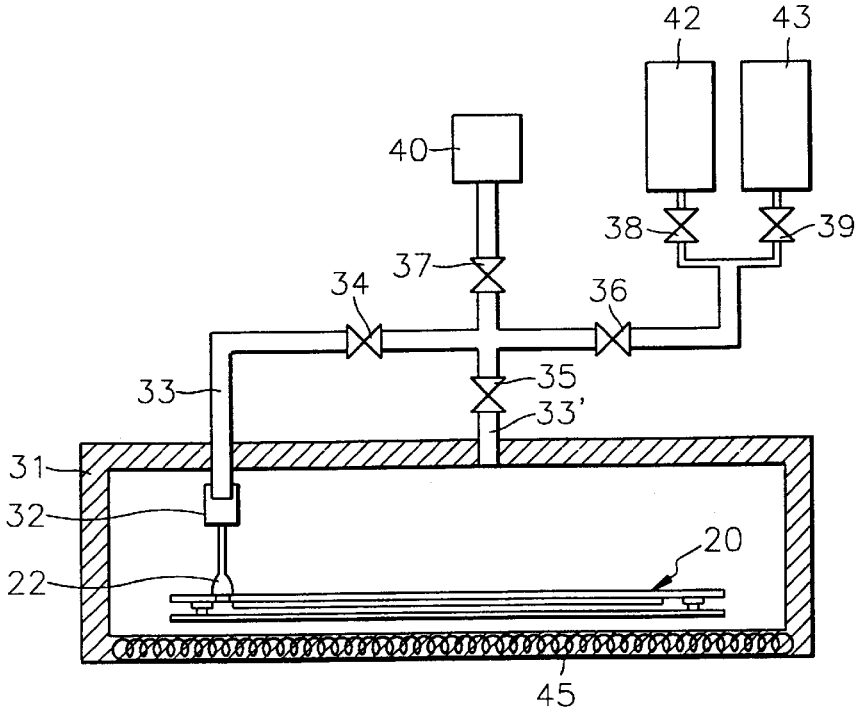
FIG. 3 is a block diagram illustrating an apparatus for fabricating a plasma display device according to the present invention.

FIG. 3 shows an installed state in which the plasma display device assembly shown in FIG. 2 is installed in an apparatus for exhausting air and filling with a discharge gas according to the present invention.

Referring to FIG. 3, the plasma display device assembly 20 is placed in a heating chamber 31. The heating chamber 31 is a space which can be maintained in a hermetically sealed state, and a heater 45 is installed at the bottom of the heating chamber 31 to heat the assembly 20. The exhaust pipe 22 connected to the assembly 20 is engaged to an exhaust head 32 installed within the heating chamber 31. The exhaust head 32 can be connected to a vacuum pump 40 and gas filling equipment 42 and 43 via piping 33. In addition, piping 33' is connected to the heating chamber 31 itself, the heating chamber 31 can be connected to the vacuum pump 40 and the gas filling equipment 42 and 43 via piping 33'. First through sixth valves 34 through 39 are selectively opened or closed to allow the assembly 20 or the heating chamber 31 to communicate with the vacuum pump 40 or the gas filling equipment 42 and 43, respectively.

The exhaustion of air and filling with discharge gas using the apparatus shown in FIG. 3 are carried out as follows.

According to a first embodiment of the present invention, the exhaustion of air within both the assembly 20 itself and the heating chamber 31 is carried out via the piping 33 and 33' simultaneously. At this time, the first, second and fourth valves 34, 35 and 37 are opened and the third valve 36 is closed. When the air begins to be evacuated, the heating chamber 31 begins to be heated by the heater 30 simultaneously. The temperature of the heating chamber 31 is raised to 400° C.–450° C. by heating.

When such evacuation and heating are carried out simultaneously, the frit glass 23 begins to melt at a temperature above 400° C. In addition, gases are generated from the frit glass 23, and such gases are exhausted out of the heating chamber 31 by the evacuation operation. The frit glass 23 melts between the substrates 11 and 12, and accordingly the substrates 11 and 12 are bonded by the pressure of the clips. At this time, the thickness of the frit glass 23 become thinner than the initial thickness, and consequently the partition walls 17 can closely contact the inner surface of the facing substrate 11.

The evacuation and heating of the heating chamber 31 are stopped after a predetermined time, and the evacuation of the assembly 20 only is continuously carried out via the exhaust pipe 22. That is, while the second valve 35 is closed, the first valve 34 is maintained open. Such cooling of the heating chamber 31 and evacuation of the assembly 20 only are continued until the temperature of the heating chamber 31 reaches 350° C. When the temperature of the heating chamber 31 reaches 350° C., a predetermined gas is supplied to the heating chamber 31 until the pressure reaches atmospheric pressure. The gas filling the heating chamber is, for example, $N_2$, Ar, Ne, dry air, or the like. That is, the first and fourth valves 34 and 37 are closed, and the second, third and fifth valves 35, 36 and 38 are opened, and the gas in the gas filling equipment 42 fills the heating chamber 31 to atmospheric pressure.

Next, the evacuation of the assembly 20 is continued again. That is, the evacuation operation is carried out while the second and third valves 35 and 36 are closed, and the first and fourth valves 34 and 37 are opened. Meanwhile, the assembly 20 is cooled until the temperature of the assembly 20 reaches room temperature at atmospheric pressure. When the temperature of the assembly 20 reaches room temperature, the evacuation of the assembly 20 is stopped and instead, another charge of the discharge gas is supplied. At this time, the fourth valve 37 is closed and the first, third and sixth valves 34, 36 and 39 are opened. The discharge gas contained in the gas filling equipment 43 can be supplied into the assembly via the piping 33 and the exhaust pipe 22. After the discharge gas fills the assembly to a predetermined pressure, the vent hole 21 of the assembly is sealed.

According to a second embodiment of the present invention, the following steps are carried out before the vent hole 21 is finally closed in the first embodiment.

When discharge gas has filled the heating chamber 31 and the assembly 20, the heating chamber 31 is opened and a discharge circuit is connected to the assembly 20. Next, the assembly 20 is caused to discharge for a predetermined time, and again the assembly 20 is evacuated. At this time, the vacuum pump 37 is operated while the first and fourth valves 34 and 37 are opened.

Next, the assembly 20 is filled with another charge of the discharge gas again. At this time, while the first, third and fifth valves 34, 36 and 38 are opened, the assembly 20 is filled with the discharge gas. Then, the discharge gas within the assembly 20 is evacuated again. At this time, the first and fourth valves 34 and 37 are opened. The assembly 20 is filled with still another charge of the discharge gas, and thereafter the vent hole 21 is sealed with flame. Such evacuation and filling of the discharge gas can be repeated more than twice. That is, in brief, the gas discharge is carried out once after the assembly 20 is assembled by bonding, and the vent hole 21 is sealed finally after the evacuation and filling of the discharge gas is repeated more than twice.

In another embodiment of the present invention, when the device and the chamber are cooled to a first predetermined temperature after they are heated, the evacuation and filling of the discharge gas is repeated, and when the device and the chamber are further cooled to a second predetermined temperature, the evacuation of the discharge gas after filling with the discharge gas and causing the discharge gas to discharge is repeated. In the following embodiments, the opening and closing operations of the valves 34 through 39 are performed similarly, and therefore the descriptions concerning the valves are omitted.

According to a third embodiment of the present invention, the exhaustion of air within both the assembly 20 in itself and the heating chamber 31 is carried out via the piping 33 and the piping 33' simultaneously. At this time, the heating chamber 31 begins to be heated by the heater 30 simultaneously with the evacuation. The temperature of the heating chamber 31 is raised to 400° C.–450° C. by heating. The frit glass 23 is melted by heating, and accordingly the substrates 11 and 12 are bonded. Gases are generated from the frit glass 23, and such gases are exhausted out of the heating chamber 31 by the evacuation operation.

Then, when the device and chamber are cooled down to the first predetermined temperature, the evacuation of the heating chamber 31 and the assembly 20 is stopped, and the discharge gas is supplied to the assembly 20. It is preferable that the discharge gas be an inert rare gas, Ar or Ne, and the gas filling pressure is in the range of from 10 to 760 Torr.

When the pressure of the discharge gas in the assembly reaches a predetermined pressure, the assembly 20 is evacuated again. It is preferable that such evacuation and filling of the discharge gas is repeated more than twice. It is effective for exhausting air and moisture remaining within the assembly 20 that the discharge gas is repeatedly filled and evacuated in a high temperature state.

After the above steps are finished, the assembly 20 and the heating chamber 31 are further cooled. The cooling is continued until the temperature of the assembly 20 reaches the second predetermined temperature in the range of 10° C. to 100° C., and it is preferable that the assembly 20 be cooled to room temperature. When the assembly 20 is cooled to the second predetermined temperature, another charge of the discharge gas is supplied to the assembly 20 to 100–700 Torr. After the discharge gas is supplied as above, the vent hole 21 is sealed to complete the display device assembly.

According to a fourth embodiment of the present invention, the gas filling operation is carried out before the vent hole 21 is finally sealed in the third embodiment. When the discharge gas has been supplied to the assembly 20, the heating chamber 31 is opened and a discharge circuit is connected to the assembly 20. After the assembly 20 is caused to discharge for a predetermined time, the assembly 20 is repeatedly evacuated and filled with the discharge gas. At this time, it is preferable that the gas pressure is in the range of about 10 to 760 Torr. It is also preferable that such filling and evacuation of the discharge gas in the assembly is repeated more than twice. Finally the assembly 20 is filled with another charge of the discharge gas, and thereafter the vent hole 21 is sealed with a flame.

Summing up the above-described steps of the fourth embodiment, the discharge gas is supplied to and evacuated from the assembly 20 more than twice in the heated state after the assembly 20 is sealed by bonding, and the discharge gas is caused to discharge in, and evacuated from the assembly 20 after the assembly 20 is cooled. Then, again another charge of the discharge gas is supplied to and evacuated from the assembly 20 more than twice. Finally, the vent hole 21 is closed after another charge of the discharge gas is filled into the assembly 20.

In the method and the apparatus for fabricating a plasma display device according to the present invention, since even very small amounts of gases and moisture remaining in a heat bonded display device can be evacuated, there are advantages in which the luminance and efficiency of the plasma display device can be highly enhanced. Further, since the filling and evacuation of a discharge gas can be carried out in a simple and fast manner, the fabricating process of the device is simple and the productivity thereof enhanced.

Although particular embodiments of the invention have been described with reference to the accompanying drawings for the purposes of illustration, it should be understood that various modifications and equivalents may be made by those skilled in the art without departing from the spirit and scope of the invention. Accordingly, it must be understood that the invention is limited only by the attached claims.

What is claimed is:

1. A method for fabricating a plasma display device comprising:

installing in a heating chamber a plasma display device assembly including upper and lower substrates and frit glass coating the peripheries of the substrates;

heating the heating chamber while evacuating the plasma display device assembly and the heating chamber via respective exhaust lines;

bonding the upper and lower substrates of the plasma display device assembly by melting and thereby spreading the frit glass over portions of the upper and lower substrates;

stopping the evacuation and heating of the heating chamber and cooling the heating chamber;

filling the heating chamber with a gas to atmospheric pressure when the heating chamber has cooled;

filling the plasma display device assembly with a discharge gas when the temperature of the plasma display device reaches room temperature;

connecting a discharge circuit to the plasma display device assembly, producing a discharge in the discharge gas within the plasma display device assembly with the discharge circuit and, thereafter, evacuating the discharge gas from the plasma display device assembly;

repeating the filling and evacuation of the plasma display device assembly with the discharge gas; and filling the plasma display device assembly with the discharge gas, and sealing the plasma display device assembly.

2. The method for fabricating a plasma display device as claimed in claim 1, including heating the heating chamber to a temperature in the range of 400° C. to 450° C.

3. The method for fabricating a plasma display device as claimed in claim 1, including filling the heating chamber with a gas to atmospheric pressure when the temperature of the heating chamber is about 350° C.

4. The method for fabricating a plasma display device as claimed in claim 1, wherein the frit glass is thicker than the height of partition walls of the device, and the partition walls contact the facing substrate when the frit glass is melted and the thickness of the frit glass decreases.

5. The method for fabricating a plasma display device as claimed in claim 1, wherein the discharge gas is selected from the group consisting of Ar and Ne.

6. The method for fabricating a plasma display device as claimed in claim 1, wherein the discharge gas is selected from the group consisting of Ne and a mixture gas of Ne and Xe.

7. A method for fabricating a plasma display device comprising:

installing in a heating chamber a plasma display device assembly including upper and lower substrates and frit glass coating the peripheries of substrates;

heating the heating chamber while evacuating the plasma display device assembly and the heating chamber;

repeating more than twice alternating filling of the plasma display device assembly with a discharge gas to a pressure and evacuating the discharge gas from the plasma display device assembly when the heating chamber has cooled to a first temperature;

filling the plasma display device assembly with the discharge gas to a pressure when the temperature of the heating chamber is further cooled to a second temperature, lower than the first temperature;

connecting a discharge circuit to the plasma display device assembly, producing a discharge in the discharge gas within the plasma display device assembly with the discharge circuit and, thereafter, evacuating the discharge gas from the plasma display device assembly;

repeating the filling and evacuation of the discharge gas in the plasma display device assembly more than twice; and filling the plasma display device assembly with the discharge gas, and sealing the plasma display device assembly.

8. The method for fabricating a plasma display device as claimed in claim 7, including heating the heating chamber higher than 400° C.

9. The method for fabricating a plasma display device as claimed in claim 7, including filling the plasma display device assembly with the discharge gas to a pressure in the range of about 10 to 760 Torr when the heating chamber is cooled to the first temperature.

10. The method for fabricating a plasma display device as claimed in claim 7, wherein the pressure of the discharge gas in the plasma display device assembly for producing the gas discharge is in the range of about 100 to 700 Torr.

11. The method for fabricating a plasma display device as claimed in claim 7, wherein the pressure of the discharge gas in the plasma display device assembly after producing the gas discharge is in the range of about 10 to 760 Torr.

12. The method for fabricating a plasma display device as claimed in claim 7, wherein the discharge gas is selected from the group consisting of Ar and Ne.

13. The method for fabricating a plasma display device as claimed in claim 7, wherein the discharge gas is selected from the group consisting of Ne and a mixture gas of Ne and Xe.

14. The method for fabricating a plasma display device as claimed in claim 7, wherein the frit glass is thicker than the height of partition walls of the device, and the partition walls contact the facing substrate when the frit glass is melted and the thickness of the frit glass decreases.

* * * * *